US007344584B2

(12) United States Patent
Coley et al.

(10) Patent No.: US 7,344,584 B2
(45) Date of Patent: Mar. 18, 2008

(54) PROCESS FOR PRODUCING METAL POWDERS

(75) Inventors: Kenneth Stark Coley, Hamilton (CA); Armen Markarian, Etobicoke (CA); Shadi Saberi, Oakville (CA); Randy Shaubel, Oakville (CA); Rinaldo A. Stefan, Mississauga (CA); Lloyd Matt Timberg, Burlingotn (CA); Eric Bain Wasmund, Hamilton (CA)

(73) Assignee: Inco Limited, Toronto (CA)

( * ) Notice: Subject to any disclaimer, the term of this patent is extended or adjusted under 35 U.S.C. 154(b) by 450 days.

(21) Appl. No.: 10/933,719

(22) Filed: Sep. 3, 2004

(65) Prior Publication Data

US 2006/0048606 A1 Mar. 9, 2006

(51) Int. Cl.
*B22F 9/28* (2006.01)

(52) U.S. Cl. ..... 75/362; 75/367

(58) Field of Classification Search ..... 75/362
See application file for complete search history.

(56) References Cited

U.S. PATENT DOCUMENTS 1,836,732 A 12/1931 Schlecht et al.
2,663,630 A 12/1953 Schlecht et al.
2,851,347 A 9/1958 Schlect et al.
3,220,875 A * 11/1965 Queneau ..... 427/216
3,367,768 A 2/1968 West et al.
3,702,761 A 11/1972 Llewelyn
4,673,430 A 6/1987 Pfeil ..... 75/0.5
4,732,110 A * 3/1988 Parsons ..... 118/719
4,808,216 A * 2/1989 Kageyama et al. ..... 75/347
4,936,250 A * 6/1990 Wiseman et al. ..... 118/716
5,085,690 A * 2/1992 Ebenhoech et al. ..... 75/362
5,853,451 A 12/1998 Ishikawa ..... 75/367
6,168,752 B1 * 1/2001 Kagohashi et al. ..... 266/171
6,235,077 B1 5/2001 Kagohashi et al. ..... 75/369
6,391,084 B1 5/2002 Ito et al. ..... 75/255
6,402,803 B1 6/2002 Katayama et al. ..... 75/246
6,454,830 B1 9/2002 Ito et al. ..... 75/255
6,494,931 B1 12/2002 Mukuno et al. ..... 75/255

FOREIGN PATENT DOCUMENTS

CA 2336863 12/2000
WO 0067936 11/2000

* cited by examiner

*Primary Examiner*—George P. Wyszomierski
(74) *Attorney, Agent, or Firm*—Edward A. Steen

(57) ABSTRACT

A process for the production of extra fine spherical metal powders by chemical vapor deposition and dissolution techniques, including metal carbonyls, wherein the metal containing process gas is propelled upwardly through a heated reactor. By employing an upward gas flow as opposed to the conventional downward gas flow, a closer approximation of theoretical plug-flow velocity profiles are achieved thusly resulting in a desirably narrower size particle distribution obviating or reducing the need for subsequent classification techniques.

15 Claims, 5 Drawing Sheets

5 cm from top 10 cm from top 15 cm from top 20 cm from top 25 cm from top 25 cm from bottom 20 cm from bottom 15 cm from bottom 10 cm from bottom 5 cm from bottom

PROCESS FOR PRODUCING METAL POWDERS

TECHNICAL FIELD

The present invention relates to metal powders in general and more particularly to a process for producing extra fine spherical metal powders

BACKGROUND OF THE INVENTION

As electronic devices inexorably decrease in size, there is a continuing need to miniaturize their individual and collective components.

In particular, there is a concerted demand for metal powders that are comprised of unagglomerated, spherical particles below 1 micron in diameter.

These powders constitute inks that can be printed as extremely thin electrodes with fired thicknesses of 1-10 microns for multi-layer ceramic capacitors ("MLCC"). Ultra fine metal powders also are used in metallization pastes and other applications.

The leading commercial process for making spherical ultra fine metal particles is by gas-phase chemical vapor deposition ("CVD"). In this reaction, a metal containing vapor is converted to aerosol metal particles by a chemical reaction initiated by conditions of high temperature. Examples of the process using $NiCl_2$ as the precursor can be found in U.S. Pat. No. 5,853,451 to Ishikowa; U.S. Pat. No. 6,235,077 B1 to Kogohaski et al.; and U.S. Pat. No. 6,391,084 B1 to Ito et al. The first patent discloses a horizontal reactor whereas the latter two patents disclose downflow vertical reactors.

Other CVD reactions utilize metal carbonyls, such as nickel carbonyl ($Ni(CO)_4$), iron carbonyl ($Fe(CO)_5$), etc. Representative processes may be found in U.S. Pat. No. 1,836,732 to Schlecht et al.; U.S. Pat. No. 2,663,630 to Schlecht et al.; U.S. Pat. No. 2,851,347 to Schlecht et al. Vertical decomposers are disclosed.

Similarly, the precursor may be a mist of a solution containing a dissolved metal or metal compound that decomposes under high temperature to yield metal particles. This CVD process, called spray pyrolysis, usually utilizes aerosol hot-wall tubular reactors.

The use of additives to control the morphology of metal powders made by CVD dates back many years. U.S. Pat. No. 3,367,768 to West et al. discloses the addition of ammonia to a decomposer. U.S. Pat. No. 3,702,761 to Llewelyn introduces forms of nitrogen oxide to expedite the process. U.S. Pat. No. 4,673,430 to Pfeil teaches the utility of adding sulfur and sulfur containing compounds to produce fine spherical nickel powders. These aforementioned references utilize the carbonyl process. U.S. Pat. No. 6,402,803 B1 to Katayama et al. similarly discloses sulfur containing particles that are made by the conventional $NiCl_2$ reduction process.

Numerous additives are known to control size, shape and crystal structure of the resultant powders. However, these additives do not eliminate or control agglomeration problems. Particles that tend to clump together, even on a microscopic scale, are deleterious to the electronic components since aggregations may cause shorting and other problems.

In spite of advances in powder production, one of the long-standing drawbacks of the CVD processes for making metal powders is that the distribution of the resultant particles are very broad. This occurs because the residence time of particles in the reactor is a function of the flow field of the carrier gas. Unless the flow field is perfectly uniform, the so-called "plug-flow" velocity profile, particles produced in different parts of the reactor will be made under different conditions of temperature, concentration and time. As a result, the CVD processes are at a disadvantage for making particles with a very narrow particle size distribution. To address this issue, industry has developed a variety of methods to classify powders made by the CVD processes so that they will be more suitable for MLCC's and other applications by narrowing the particle size distribution. Classification methods such as hydro-cycloning, air classification and centrifugation are taught in various patents such as U.S. Pat. No. 6,494,931 B1 to Mukuno et al. and U.S. Pat. No. 6,454,830 B1 to Ito et al. for producing CVD powders having the desired size profile. Disadvantages of these approaches are that the additional process steps contribute significantly to the overall production cost.

Hot wall tube reactors (also known as decomposers) have been used for more than 70 years to make fine powders by the decomposition of nickel and iron carbonyl vapors. In the standard configuration, metal carbonyl vapors in an inert carrier gas flow into the top of the reactor through a nozzle. The reactor typically has a length to diameter ratio of about 5:1 and is heated by conduction through the walls. The metal carbonyl decomposes in the inner space of the otherwise empty reactor and the resultant aerosol is carried down through the reactor and into a powder consolidator. One of the features of feeding the gas from the top of the reactor is that the settling of particles in the consolidator is aided by gravity. Unfortunately, the flow field that results from this configuration is not uniform and so it is not optimal for producing metal particles with desired narrow size distributions.

The present inventors determined that the size distribution of nickel particles made by the CVD reaction of $Ni(CO)_4$ in a hot-wall tube reactor can be significantly narrowed by designing the flow field of the process gas in the reactor such that the velocity profile is closer to the ideal plug-flow form, in which all parcels or flux of the fluid are traveling within the reactor at the same velocity. In contrast, under current practices the gravity driven velocity profile due to wall boundary conditions and temperature gradients, among other factors, when fully developed is closer to the parabolic form in which particles at the center of the flow are traveling more quickly than particles near the walls, resulting in a broad dissimilar residence time distribution and subsequent large and variable particle size distribution.

SUMMARY OF THE INVENTION

There is provided a gas based process for producing extra fine and unagglomerated metal powder from a CVD process gas source by introducing the metal containing process feed gas into the bottom of the reactor instead of through the top or middle of the reactor.

PREFERRED EMBODIMENT OF THE INVENTION

Figure 1:
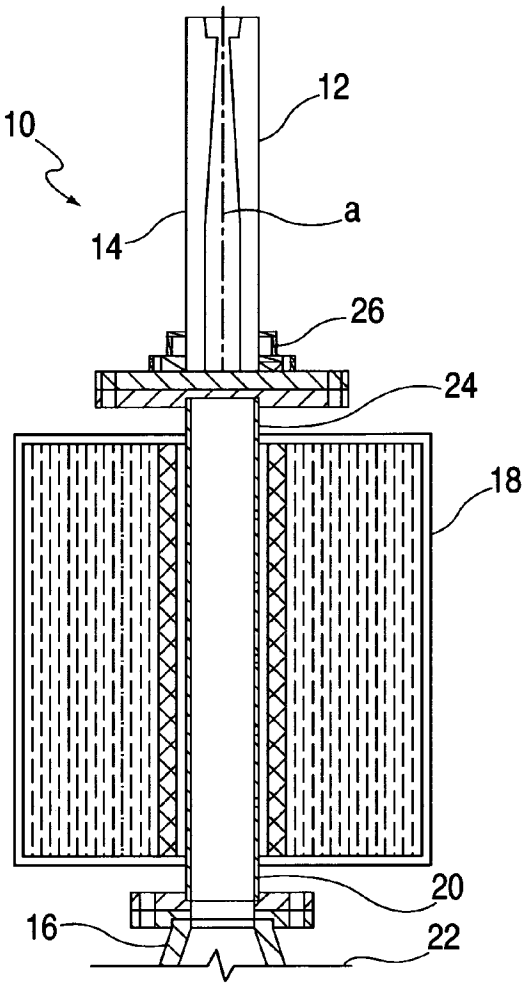
FIG. 1 is an elevation in cross section of the prior art.
Figure 3A:
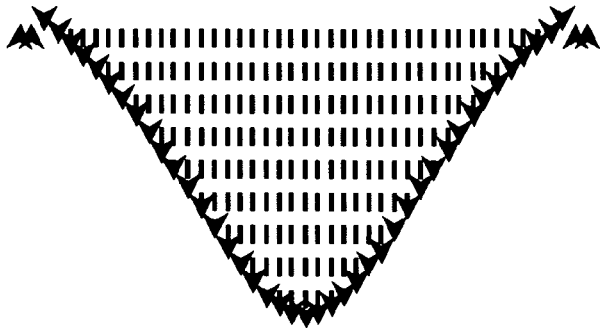
FIG. 3 contains a series of velocity profiles.
Figure 3B:
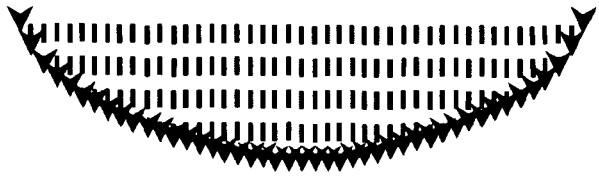
Figure 3C:
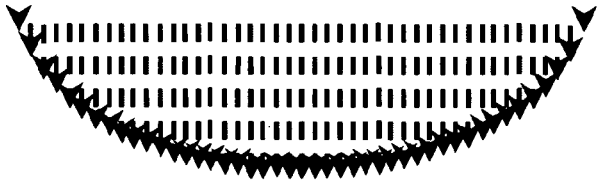
Figure 3D:
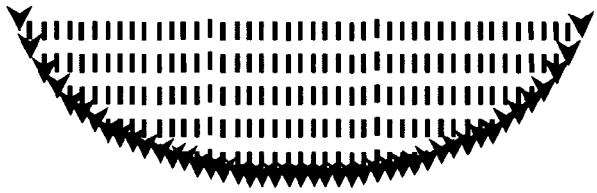
Figure 3E:
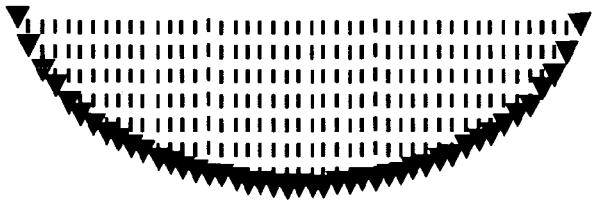
Figure 4E:
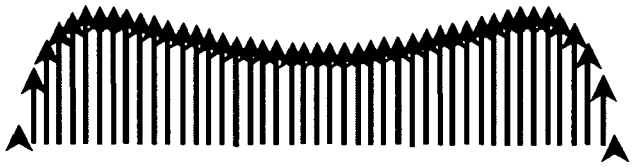
FIG. 4 contains a series of velocity profiles.
Figure 4D:
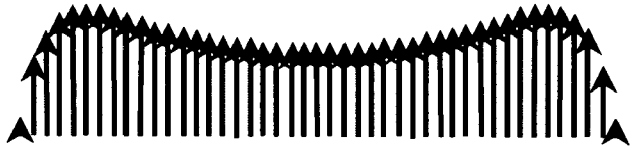
Figure 4C:
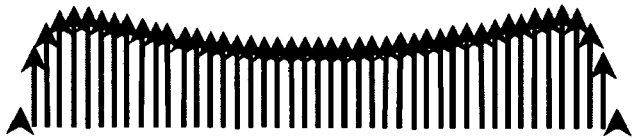
Figure 4B:
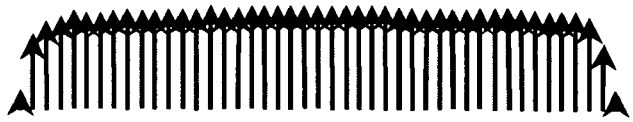
Figure 4A:
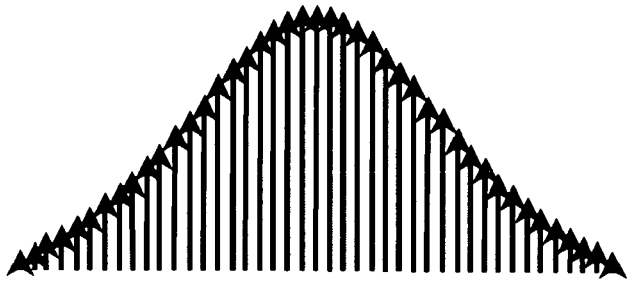

FIG. 1 represents the current prior art practice of employing an essentially vertically oriented downflow reactor 10 having a vertical axis of symmetry a at least substantially perpendicular to horizontal support 22. Initial CVD process gases are downwardly introduced to the inlet 12 situated at the upper end 14 of reactor 10. The reactor is heated by coils 18 and the resultant metal particles exit from the outlet 16 located at the lower end 20 of the reactor 10. Typical controls, safety devices, instrumentation, ports, etc. are not shown for simplicity.

The terms "upper", "lower", "top", "bottom", "vertical" and "horizontal" are arbitrary conventions used to orient the various components. The adjective "about" before a series of values shall be interpreted as also applying to each value in the series unless otherwise indicated. "Ultra fine", "extra fine" and "fine" are synonymous terms for particles having diameters of about 1 micron and less.

In reactor 10 shown in FIG. 1, processing by decomposition of the gaseous precursor substantially occurs in inner tube 24 surrounded by the heating coils 18. The inlet 12 introduces the CVD process gases through a water cooled nozzle 26.

Figure 2:
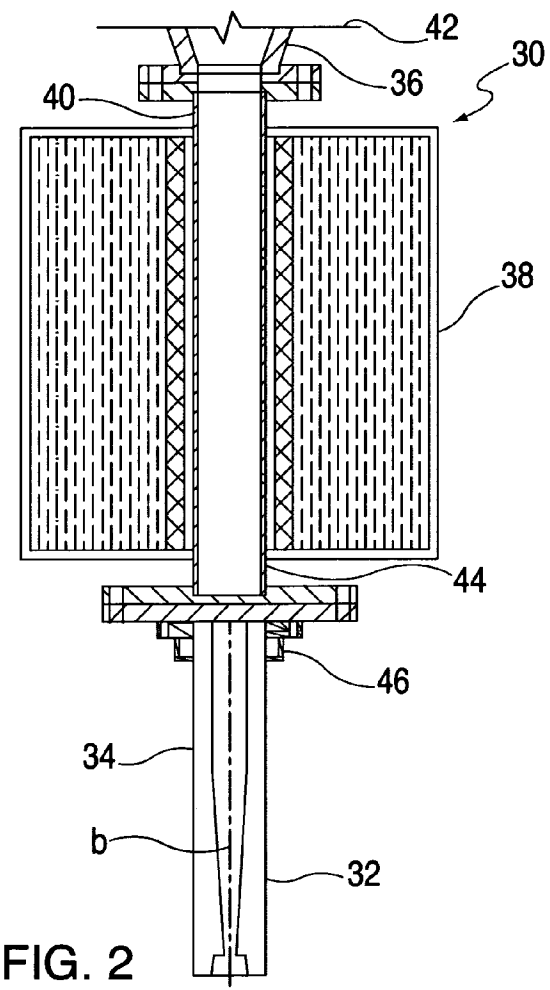
FIG. 2 PRIOR ART
FIG. 2 is an elevation in cross section of an embodiment of the invention.

FIG. 2 represents an embodiment of the present invention by inverting a conventional reactor to provide for an upflow reactor 30 having a vertically oriented axis of symmetry b at least substantially perpendicular to substantially horizontal support 42. Initial CVD process gas or gases are introduced into the reactor 30 via the inlet 32 disposed at the lower end 34 of the reactor 30. The CVD gases are propelled upwardly through the reactor 30 by a differential pressure and heated by coils 38 whereupon the particles exit from the outlet 36 located at the upper end 40 of the reactor 30.

The reactions occur in liquid free inner tube 44 surrounded by the heating coils 38. The inlet 32 introduces the CVD process gas or gases through a water cooled nozzle 46.

There are two families of methods for evaluating the 3-dimensional internal flow profiles in a reactor: a) physical models and b) computational fluid dynamics. In the former method, a physical model of the system is built and flow measurements are taken from the model. Alternatively, computational fluid dynamics ("CFD") can be used to solve the equations of mass and energy conservation across a large 3-dimensional array of cells. CFD has the advantage that the effects of temperature, chemical reaction, and gas composition can all be included in the calculations.

A CFD analysis was performed using CFX™ 4.4 software (ANSYS, Inc., Cannonsburg, Pa., USA) for the reactor 10 and 30 geometry shown in FIGS. 1 and 2 (22 mm diameter inlet nozzle 12, 45 mm inside tube 24 diameter, 250 mm tube 24 height). The analysis was performed for a flow scenario designated as Case A. Case A consists of a feed-gas with a flow rate of about 18 slpm (standard liters per minute) comprised of about 2 volume percent $Ni(CO)_4$ and about 400 ppm (parts per million) $NH_3$ in a balance of CO with the outside wall temperatures of the reactor 10 at an average temperature of about 620° C. In the first simulation, the feed gas was fed from the top of the reactor 10, which is the conventional configuration. The reactor 10 geometry is shown in FIG. 1 and will hereafter be referred to as the "downflow configuration". In the second simulation, the identical conditions of flow and temperature were used, except that the feed-gas was fed from the inlet 32 in the bottom of the reactor 30. The reactor 30 geometry is shown FIG. 2 and will be referred to as the "upflow configuration". In both instances the internal inlets 12 and 32 diverge to 22 mm.

The resulting velocity profiles for each simulation, Case A downflow and Case A upflow, are shown as FIGS. 3 and 4 respectively. Each measurement was taken from the top and the bottom of the inlets 12 and 32 respectively. It can be seen from these profiles that the initial entrance effects in both cases lead to a non-uniform velocity profile. See FIG. 3(*a*) and FIG. 4(*a*). However, in the Case A upflow simulation the velocity profile begins to approach the ideally preferred plug-flow shape (FIGS. 4*b*-4*e*), while the Case A downflow retains the debilitating parabolic profile (FIGS. 3*b*-*c*). As noted earlier, it has been hypothesized by the inventors that CVD powders made in the plug-flow flow field will have a more narrow size distribution, making them advantageous for MLCC powders and other applications.

Figure 5:
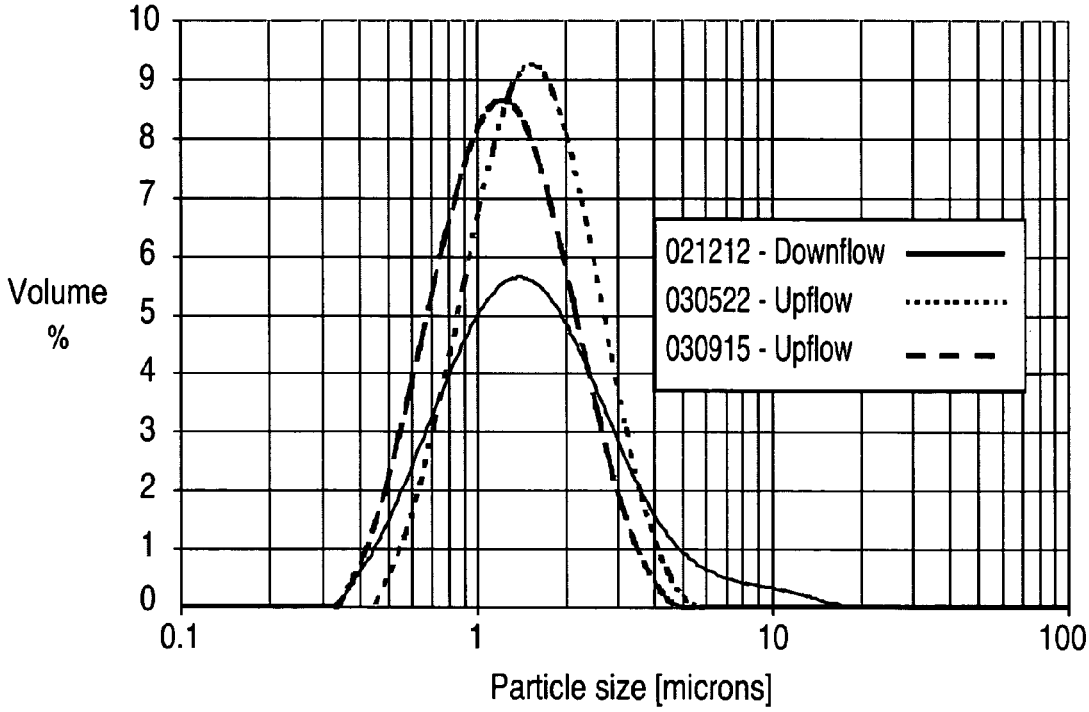
FIG. 5 is a graph of particle size distributions.

Three tests were run in an experimental reactor for the Case A flow scenario. Test 021212 was conducted in the downflow configuration and Tests 030522 and 030915 were run in the upflow configuration. The resulting powder from each experiment was analyzed for particle size distribution ("PSD") by laser light scattering (Malvern Mastersizer™2000); specific surface area ("SSA"); crystallite size ("Crys") by x-ray diffraction (XRD); and chemical analysis. The results are shown in Table 1. The volume particle size distribution by light scattering for these experiments is shown as FIG. 5. The main benefit of the upflow orientation has been the removal of the right side "coarse shoulder" of the size distribution that extends from approximately 5 to 16 microns.

TABLE 1

| | | Powder properties | | | | | | | | |
|---|---|---|---|---|---|---|---|---|---|---|
| | | SSA | Mass PSD by Malvern Light Scattering [microns] | | | | Crys size | Bulk Chemical Analysis [mass %] | | |
| Experiment | Conditions | [$m^2$/g] | $D_{10}$ | $D_{50}$ | $D_{90}$ | $D_{100}$ | [nm] | C | O | S |
| 021212 | Case A downflow | 2.87 | 0.70 | 1.54 | 3.78 | 15.82 | 73 | 0.12 | 0.53 | |
| 030522 | Case A upflow | 4.46 | 0.73 | 1.45 | 2.90 | 5.73 | 63 | 0.29 | 0.93 | |
| 030915 | Case A upflow | 5.99 | 0.66 | 1.26 | 2.41 | 4.50 | 46 | 0.28 | 1.35 | |
| 030905 | Case A upflow | 4.80 | 0.36 | 0.79 | 1.66 | 3.17 | 83 | 0.15 | 1.45 | 0.35 |

TABLE 1-continued

| Experiment | Conditions | SSA [m²/g] | Mass PSD by Malvern Light Scattering [microns] $D_{10}$ | $D_{50}$ | $D_{90}$ | $D_{100}$ | Crys size [nm] | Bulk Chemical Analysis [mass %] C | O | S |
|---|---|---|---|---|---|---|---|---|---|---|
| | with $SO_2$ | | | | | | | | | |
| 030606 | Case B with 1600 ppm $SO_2$ | 5.45 | 0.31 | 0.65 | 1.31 | 2.50 | 120 | 0.08 | 1.41 | 0.41 |
| 030611 | Case B with 200 ppm $SO_2$ | 4.29 | 0.37 | 0.79 | 1.60 | 3.16 | 140 | 0.09 | 1.10 | 0.19 |
| 030702 | Case B with 800 ppm $SO_2$ | 4.17 | 0.36 | 0.72 | 1.37 | 2.50 | 120 | 0.11 | 1.31 | 0.32 |
| 030707 | Case B with 400 ppm $SO_2$ | 4.46 | 0.36 | 0.72 | 1.36 | 2.48 | 140 | 0.06 | 1.24 | 0.29 |
| 030714 | Case B with 1200 ppm $SO_2$ | 4.62 | 0.35 | 0.76 | 1.54 | 2.76 | 94 | 0.08 | 1.84 | 0.41 |

In a laminar flow regime, the parcels of fluid within the reactor travel together with a minimum amount of interaction. If the velocity profile of the reactor is not uniform, each parcel of fluid will have a different residence time and temperature profile and subsequently the particle size distribution will be broader. CFD can be used to estimate the deviation from plug-flow conditions, and therefore it can provide an indication of whether a particular reactor design can be expected to give improvements in narrowing the size distribution.

To quantify the deviation from plug-flow conditions, a comparison index can be invoked to quantify the difference between two flow profiles based on the minimization of variation in the residence time distribution. The quantity to be minimized is the summation over the radius of the deviations between the local velocity and the mean velocity—the minimum of this quantity corresponds to the condition where the velocity profile is flat, and all of the fluid elements in the flow field have the same residence time. Each of the contributions to this summation should be weighted by the corresponding mass flux. From the principle of continuity, the mass flux is proportional to the axial velocity multiplied by the square of the radius. The comparison index, which should be minimized, is calculated via the following equation:

$$\sum_{i=1}^{i=i_{max}} |v_i|(r_i^2 - r_{i-1}^2)|v_i - v_{avg}| \qquad \text{Equation 1}$$

where $v_i$ and $r_i$ are the axial velocity and tube radius for the $i^{th}$ element of the summation. If the velocity profile is symmetric about the center of the tube, then the summation can be over one half of the tube diameter. For two velocity profiles with all other conditions being equal, the plug-flow characteristics will be best for the profile with the smaller value of this comparison index.

Table 2 shows this comparison index for Case A upflow and downflow conditions, demonstrating mathematically how the upflow configuration should produce a more narrow residence time distribution than the downflow configuration. This result has been borne out through the comparison of experimental results from Experiments 021212 and 030522 and 030915, the experiments done in the upflow configuration have less agglomerate particles, all other factors being equivalent.

TABLE 2

Values of the comparison index (Eqn 1) for the velocity profiles of Case A downflow and Case A upflow.

| Axial Distance from Inlet 12/34 | Case A Downflow | Case A Upflow |
|---|---|---|
| 5 cm | $3.12 \times 10^{-5}$ | $2.25 \times 10^{-5}$ |
| 10 cm | $1.29 \times 10^{-5}$ | $4.28 \times 10^{-6}$ |
| 15 cm | $1.51 \times 10^{-5}$ | $7.05 \times 10^{-6}$ |
| 20 cm | $1.74 \times 10^{-5}$ | $9.13 \times 10^{-6}$ |
| 25 cm | $1.88 \times 10^{-5}$ | $9.84 \times 10^{-6}$ |

Figure 6:
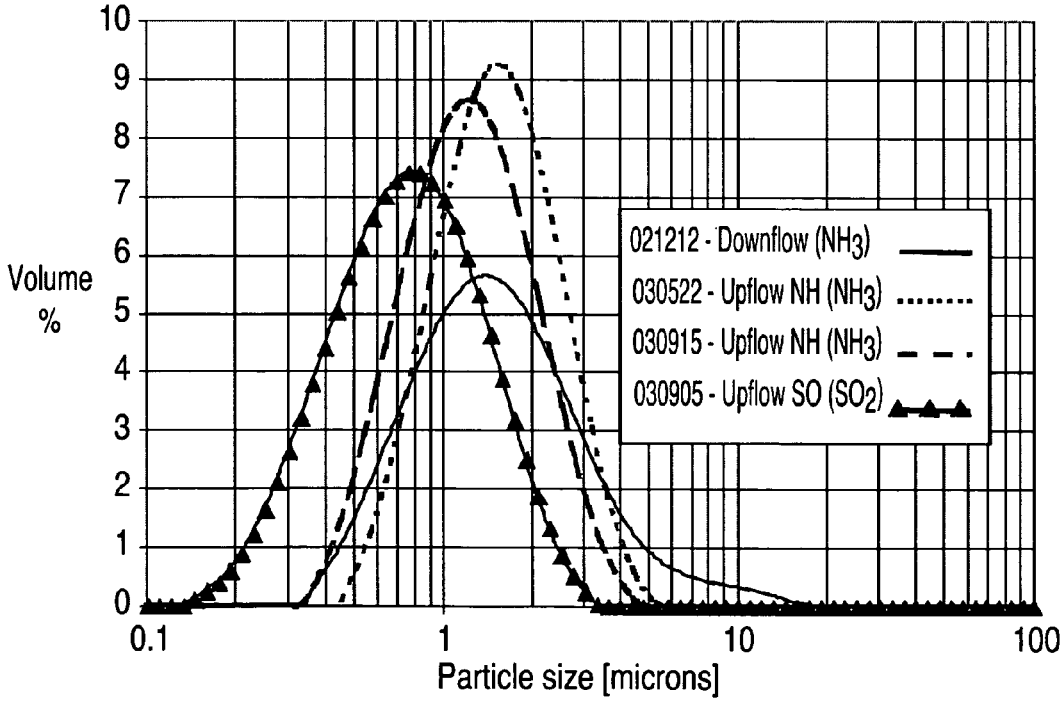
FIG. 6 is a graph of particle size distributions.

The experiments described previously are not meant to represent the finest particle size attainable, but rather to highlight that a computational fluid dynamic analysis of the reactor flow field can be used to develop a mathematical comparison index that can be used for comparing between two designs, with all other factors being equivalent. Particularly, it has been shown that this principle can be used to determine that running the traditional inverted CVD tube reactor 30 in the upflow configuration can yield a more narrow particle size distribution. It can be demonstrated that an even finer particle size can be achieved by using $SO_2$ in the place of $NH_3$. Experiment 030905 was run under the Case A conditions using the upflow configuration and has an even finer particle, as shown in FIG. 6 and Table 1. It is already well known from previous Inco work conducted in the 1940's in U.S. Pat. No. 4,673,430 to Pfeil, that sulfur and sulfur containing dopants are useful to reduce the particle size. Undisclosed sulfur bearing gases are also taught in U.S. Pat. No. 6,402,803 B1 to Katayama et al. However in the patent, it is disclosed that sulfur is used to control the crystal habit of the particles. In the present invention, the presence of sulfur had no apparent effect on particle morphology compared with the usual additive which is $NH_3$.

Case B was run under the following conditions: about 13 slpm of process gas comprised of between about 3.1 to 3.8 volume percent nickel carbonyl with varying levels of $SO_2$ in a balance of CO with average outside wall temperature about 620° C.

A CFD analysis was run for the Case B conditions. Table 3 shows that the comparison index developed earlier is again lower in the upflow mode, indicative of a more narrow residence time distribution. The experimental results for Case B in the upflow configuration are shown in Table 1. $SO_2$ was tested in levels from about 200 to 1600 ppm. It can be seen that the particle size was quite similar for all of the experiments, showing that the combination of optimizing the flow field, and using known additives can make very fine particles with a narrow size distribution. Over the range of experiments, as the $SO_2$ level in the gas was increased, sulfur in the final product increased, carbon level was unaffected, the crystallite size decreased slightly, oxygen increased, and the $d_{50}$ and $d_{100}$ of the volume distribution both decreased. The level of $SO_2$ can be used to determine the exact combination of properties desired for the final application. A level of about 400 ppm $SO_2$ provides a good compromise of all of these properties for MLCC applications.

Figure 7:
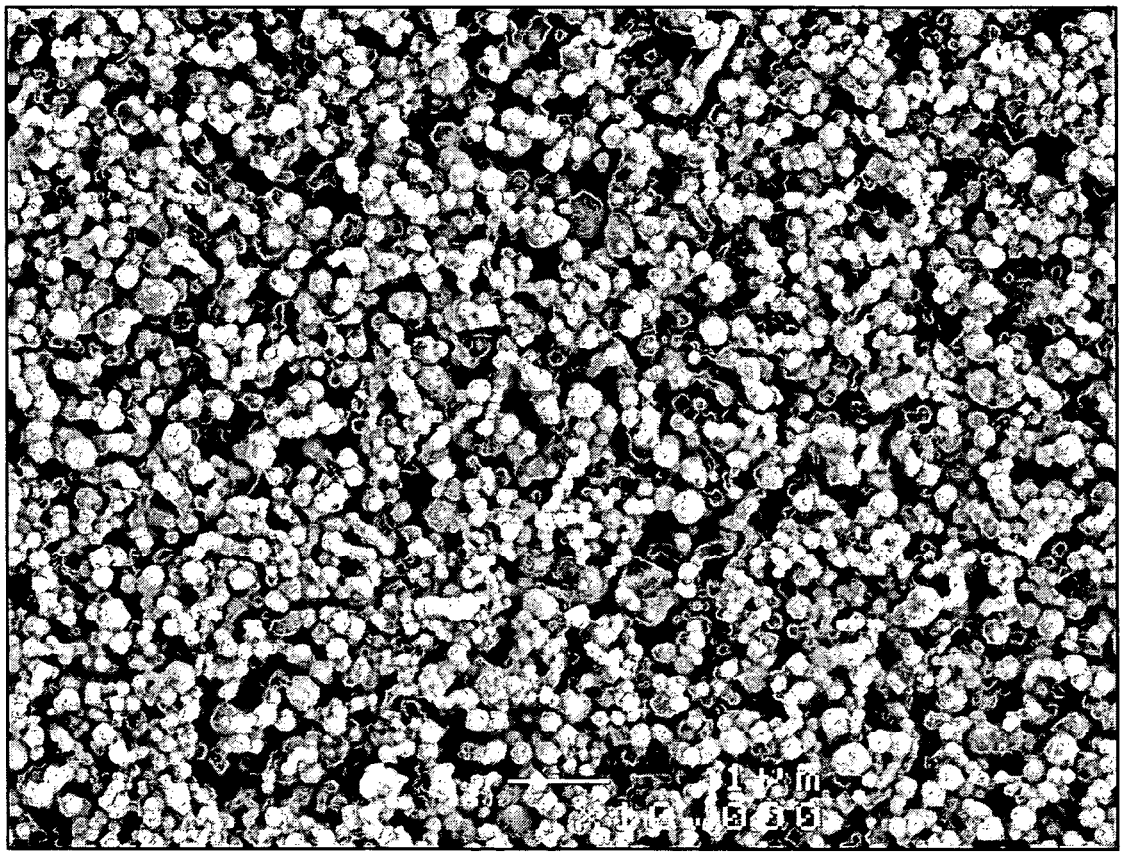
FIG. 7 is a photomicrograph of metal powder provided in accordance with an embodiment of the invention.

FIG. 7 shows a micrograph image of powder from an experiment run under identical conditions to Experiment 030707 to demonstrate the size and shape of the particles produced by the upflow process.

TABLE 3

Values of the comparison index (Eqn 1) for the velocity profiles of Case B downflow and Case B upflow.

| Axial Distance from Inlet 12/34 | Case B Downflow | Case B Upflow |
|---|---|---|
| 5 cm | $3.24 \times 10^{-5}$ | $7.92 \times 10^{-6}$ |
| 10 cm | $1.25 \times 10^{-5}$ | $4.17 \times 10^{-6}$ |
| 15 cm | $5.33 \times 10^{-5}$ | $10.6 \times 10^{-6}$ |
| 20 cm | $5.52 \times 10^{-5}$ | $9.69 \times 10^{-6}$ |
| 25 cm | $6.02 \times 10^{-5}$ | $8.21 \times 10^{-6}$ |

The present invention may be utilized with any CVD process in general and metal carbonyl in particular such as nickel carbonyl, iron carbonyl, cobalt carbonyl, etc.

As previously noted current CVD processes utilizing vertical reactors traditionally feed the process gases from the top. By introducing the process gas or gases from the bottom of the reactor, narrower residence times and tighter powder size distributions result from the adoption of the upflow process.

It will be appreciated by those skilled in the art that the present process expeditiously produced ultra fine spherical powder because the metal containing process gas is propelled upwardly through the reactor 30. Advantageously, the axis of symmetry b is preferably vertically oriented perpendicularly to the ground or other substantially horizontally disposed support surface 42. However, small deviations from the normal may be expected in actual commercial practice. The key to the process is the causation of the vertically upwardly flowing plug-flow velocity profile. Any upwardly oriented reactor 30 is acceptable provided it permits at least a substantially upward process gas flow.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

What is claimed is:

1. A thermal chemical vapor deposition process for producing metal powders having a narrow particle size distribution, the process consisting essentially of: providing a vertically oriented heated reactor having an upper portion and a lower portion, introducing a metal containing process gas into the lower portion of the reactor, propelling the metal containing process gas upwardly through the reactor, initiating the decomposition of the metal containing process gas within the reactor, causing the metal containing process gas to assume an upwardly traveling plug-flow velocity profile within the reactor, causing the metal within the metal containing process gas to form particles, and expressing the particles from the upper portion of the reactor.

2. The process according to claim 1 wherein the reactor has a longitudinal vertical axis of symmetry at least substantially perpendicular to a substantially horizontal reactor support.

3. The process according to claim 1 wherein the metal particles are created from the decomposition of a gas selected from the group consisting of metal carbonyl and nickel chloride.

4. The process according to claim 3 wherein the metal carbonyl is selected from the group consisting of one or more of nickel carbonyl, iron carbonyl, and cobalt carbonyl.

5. The process according to claim 1 wherein a dopant selected from the group consisting of one or more of sulfur, sulfur dioxide, and ammonia is introduced into the reactor.

6. The process according to claim 1 wherein the particles are at least substantially spherical and have diameters equal to or less than about one micron.

7. The process according to claim 1 wherein the reactor is a tube reactor.

8. An improved thermal method for producing extra fine metal powders by chemical vapor deposition wherein the improvement consists essentially of propelling a metal containing processing gas upwardly through a heated reactor in an at least an approximate plug-flow velocity profile in which all flux of the processing gas are traveling in the reactor at substantially the same velocity thusly reducing dissimilar particle residence times within the reactor to produce particles having a narrow particle size distribution.

9. The improved method according to claim 8 wherein the reactor is at least substantially vertically oriented having a lower portion and an upper portion.

10. The improved method according to claim 9 wherein the metal processing gas is introduced into an inlet disposed in the lower portion of the reactor.

11. The improved method according to claim 9 wherein the powders are expressed from the upper portion of the reactor.

12. The improved method according to claim 8 wherein a dopant selected from the group consisting of one or more of sulfur, sulfur dioxide and ammonia is introduced into the reactor.

13. The improved method according to claim 12 wherein sulfur dioxide is introduced into the reactor at a level of about 200 to 1600 ppm.

14. The improved method according to claim 8 wherein the metal containing process gas is selected from the group consisting of one or more of nickel carbonyl, iron carbonyl, and cobalt carbonyl.

15. The improved method according to claim 8 wherein the metal containing process gas is nickel chloride.

* * * * *